US007653323B2

(12) United States Patent
Sone et al.

(10) Patent No.: US 7,653,323 B2
(45) Date of Patent: Jan. 26, 2010

(54) FIXING APPARATUS AND IMAGE PROCESSING APPARATUS

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 233 days.

(21) Appl. No.: 11/736,075

(22) Filed: Apr. 17, 2007

(65) Prior Publication Data

US 2008/0260415 A1 Oct. 23, 2008

(51) Int. Cl.
*G03G 15/20* (2006.01)

(52) U.S. Cl. ..... 399/69; 399/88

(58) Field of Classification Search ..... 399/69, 399/67, 70, 82, 88, 328, 330, 334, 33, 37; 219/216; 347/156
See application file for complete search history.

(56) References Cited

U.S. PATENT DOCUMENTS

2005/0084276 A1* 4/2005 Hirst et al. ..... 399/81
2005/0207774 A1* 9/2005 Sone et al. ..... 399/69
2006/0051112 A1* 3/2006 Matsusaka et al. ..... 399/69 X
2006/0165429 A1* 7/2006 Satoh et al. ..... 399/69
2007/0098432 A1* 5/2007 Mashiki ..... 399/88
2007/0107982 A1* 5/2007 Sullivan ..... 181/249
2007/0122174 A1* 5/2007 Yamamoto ..... 399/88

FOREIGN PATENT DOCUMENTS

JP 02-217876 A * 8/1990
JP 10-208873 8/1998
JP 2002-064941 2/2002
JP 2004-316741 A * 11/2004
JP 2005-017658 1/2005
JP 2005-084127 A * 3/2005
JP 2005-338430 A * 12/2005
JP 2006-171481 A * 6/2006
JP 2007-034011 A * 2/2007

* cited by examiner

*Primary Examiner*—Sophia S Chen
(74) *Attorney, Agent, or Firm*—Turocy & Watson, LLP

(57) ABSTRACT

According to an embodiment, a heating device having a plurality of heating members which heat the heating roller, a first thermoelectric converting section having a plurality of thermoelectric converting elements, each of which has a heat-absorbing surface and a cooling surface and generates electromotive force by difference in temperature between the heat-absorbing surface and the cooling surface, and formed along a curved surface of the heating roller, in which the heat-absorbing surface is disposed with a predetermined space from an outer circumferential surface of the heating roller, an auxiliary power supply charged with electric power generated by the first thermoelectric converting section, and a switching section which switches the apparatus between a first state in which electric power is supplied from utility power to the heating members and a second state in which electric power is supplied from the auxiliary power supply to the heating members, based on a predetermined signal.

9 Claims, 6 Drawing Sheets

FIXING APPARATUS AND IMAGE PROCESSING APPARATUS

BACKGROUND OF THE INVENTION

1. Field of the Invention

This invention relates to an image processing apparatus such as copying machines and printers which form images on a transfer member by electrophotographic process, and a fixing apparatus which is mounted on the image processing apparatus and fixes developer on a transfer member to the transfer member.

2. Description of the Related Art

It is known that, in copying machines and printers using electric process, toner images formed on a photosensitive drum is transferred to a transfer member, and then the toner images fused by a fixing apparatus including a heating roller and a pressurizing roller is fixed onto the transfer material.

In recent years, demand for high-speed image processing apparatuses has increased, and fixing rollers having high heat capacity have been used to perform image processing at high speed. However, even when electric power supplied to the heater is increased to increase the heat capacity of the fixing roller, increase in temperature of the fixing roller cannot follow increase in temperature of the heater. Therefore, it is necessary to increase the electric power supplied to the heater.

Further, if sufficient electric power to be supplied to the heater cannot be secured, there is the problem that the time required to increase the temperature of the fixing roller to a certain fixing temperature is not shortened and thus a long warm-up time is required.

For example, as disclosed in Jpn. Pat. Appln. KOKAI Pub. No. 2005-17658, known is a technique in which thermal energy of a fixing heater such as surplus heat is converted into electric energy by a thermoelectric converter, electric power output from the thermoelectric converter is stored in a storage circuit, and the electric power is supplied to the fixing heater when the fixing apparatus is started up.

However, thermoelectric converters leak much heat, and there is the possibility that surplus heat of the fixing apparatus is taken by surrounding frame members. Therefore, the function of the thermoelectric converters is not effectively used.

Further, as disclosed in Jpn. Pat. Appln. KOKAI Pub. No. 2002-64941, known is a technique in which heat generated by a microprocessor is converted into electric energy by a Peltier device, and thereby a secondary battery is charged. If the apparatus is in a power-saving mode and a power-supply circuit is turned off, the secondary battery discharges electric power, and the electric power is supplied to a RAM, an image memory and a subsidiary CPU.

Furthermore, Jpn. Pat. Appln. KOKAI Pub. No. 10-208873 discloses a heating apparatus having heating means such as a magnetron and a heater, which heats cooked food, provided with a thermoelectric converter which converts waste cooking heat of the cooked food, waste heat of the magnetron, and surplus heat of the heater into electric power.

BRIEF SUMMARY OF THE INVENTION

According to an aspect of the present invention, there is provided a fixing apparatus comprising:

a heating roller which provides heat to a developer-holding medium holding a developer image;

a pressurizing roller which is in contact with the heating roller;

a heating device having a plurality of heating members which heat the heating roller;

a first thermoelectric converting section having a plurality of thermoelectric converting elements and formed along a curved surface of the heating roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the heating roller;

an auxiliary power supply charged with electric power generated by the first thermoelectric converting section; and a switching section which switches the apparatus between a first state in which electric power is supplied from utility power to the heating members and a second state in which electric power is supplied from the auxiliary power supply to the heating members, based on a predetermined signal.

According to another aspect of the present invention, there is provided an image processing apparatus comprising:

an image carrier which forms an electrostatic latent image;

a developing device which provides a developer to the image carrier and thereby changes the electrostatic latent image into a developer image;

a transfer device which transfers the developer formed on the image carrier to a developer-holding medium;

a fixing apparatus including:

a heating roller which provides heat to the developer-holding medium holding the developer image;

a pressurizing roller which is in contact with the heating roller;

a heating device having a plurality of heating members which heat the heating roller;

a first thermoelectric converting section having a plurality of thermoelectric converting elements and formed along a curved surface of the heating roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the heating roller;

an auxiliary power supply charged with electric power generated by the first thermoelectric converting section; and a switching section which switches the apparatus between a first state in which electric power is supplied from utility power to the heating members and a second state in which electric power is supplied from the auxiliary power supply to the heating members, based on a predetermined signal;

and a control section which outputs the predetermined signal to the switching section, and thereby instructs switching between the first state and the second state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An example of an image processing apparatus, to which an embodiment of the present invention is applied, is described with reference to drawings.

Figure 1:
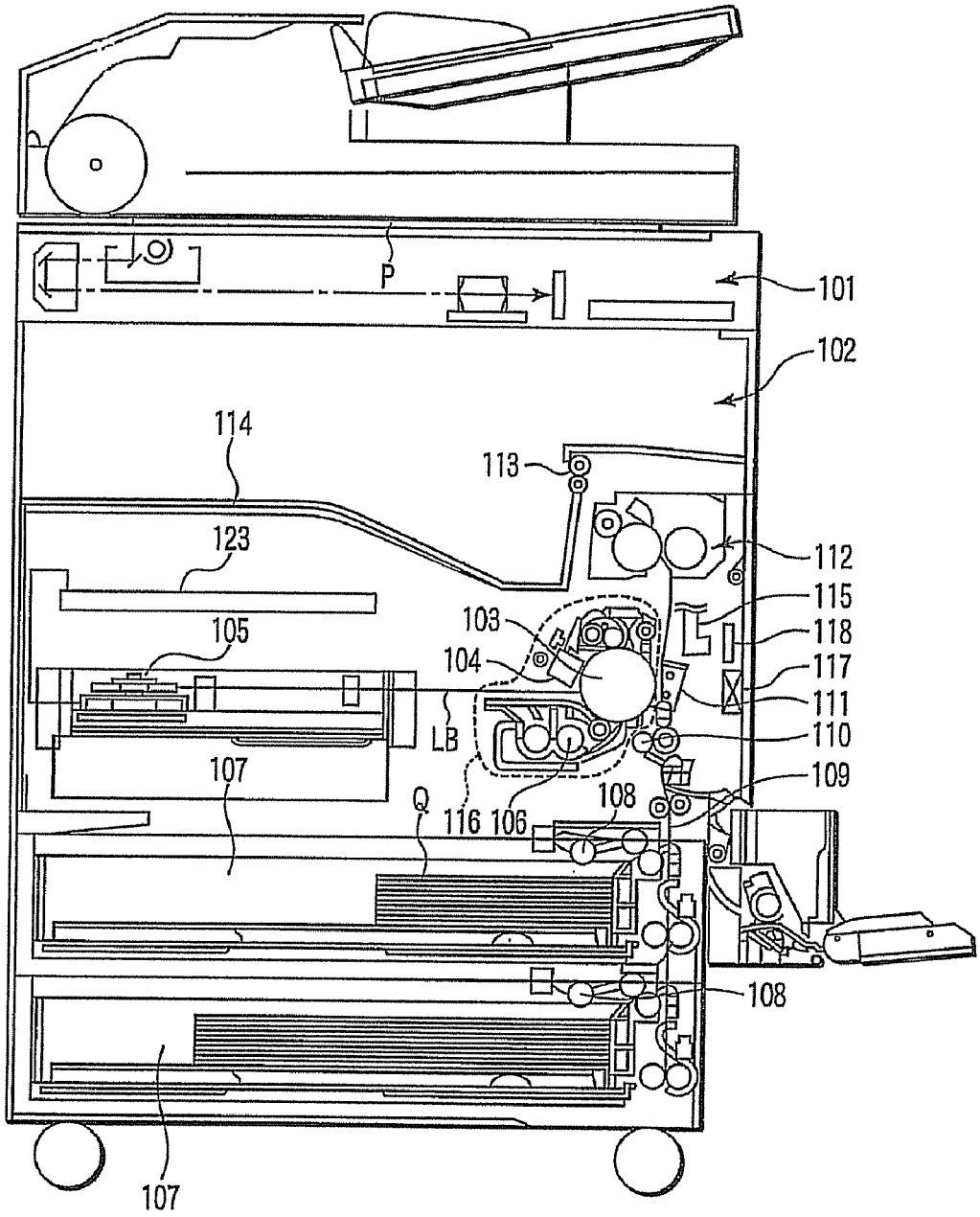
FIG. 1 is a schematic diagram illustrating an example of an image processing apparatus to which an embodiment of the present invention is applicable.

FIG. 1 schematically illustrates an image processing apparatus from the front (front side), with a cover thereof removed.

As illustrated in FIG. 1, an image processing apparatus (digital copier) 100 comprises an image reading device (scanner section) 101 which reads an image of a reading or copying object (an original) P and generates an image signal, and an image forming section (printer section) 102 which forms an image based on the image signal output from the scanner 101 or an image signal provided from the exterior through an interface 123 which communicates with the exterior.

The image forming section 102 has a photosensitive drum 103, a charging device 104, an exposure device 105, a developing device 106, paper cassettes 107, pick-up rollers 108, a conveying roller 109, an aligning roller 110, a transfer device 111, a fixing apparatus 112, a delivery roller 113, an output tray 114, a duct 115, a process unit 116, a fan 117, and a duct-side thermoelectric converting section 118.

The photosensitive drum (image carrier, image carrier means) 103 has a photosensitive member on an outer circumferential surface thereof. The photosensitive member is irradiated with light with a predetermined potential provided. Potential of regions of the photosensitive member, to which light is applied, is changed, and the photosensitive member holds the change of potential as an electrostatic image for a predetermined time. The photosensitive member may have a belt-like shape, instead of a drum-like shape.

The charging device 104 charges the surface of the photosensitive drum 103 with a predetermined potential. The charging device 104 may be a corona wire, a contact roller, or a contact blade.

The exposure device 105 is disposed downstream from the charging device 104 in the rotational direction of the photosensitive drum 103. The exposure device 105 exposes the photosensitive drum 103 to a laser beam LB whose light intensity is changed in accordance with an image signal supplied from the scanner 101. Further, the exposure device 105 exposes the photosensitive drum 103 to a laser beam LB in accordance with a predetermined image signal supplied from the exterior through the interface 123.

The developing device 106 is disposed downstream from the exposure device 105 in the rotational direction of the photosensitive drum 103. The developing device 106 stores a two-component developer containing carrier and toner, and supplies the developer (toner) to the surface of the photosensitive drum 103. Thereby, a latent image on the surface of the photosensitive drum 103 is visualized, and thereby a toner image is formed. The developer may be a one-component developer containing only toner.

The paper cassette 107 stores paper Q, and the pick-up roller 108 takes out paper Q one by one. The paper Q is conveyed to the aligning roller 110 by the conveying roller 109.

The aligning roller 110 rotates at a predetermined timing to align the paper Q with the toner image formed on the photosensitive drum 103, and conveys the paper Q to a transfer position.

The transfer device 111 applies a predetermined potential to the paper Q, and transfer the toner image on the photosensitive drum 103 to the paper Q. The transfer device 111 may be a corona wire, a contact roller, or a contact blade.

The fixing apparatus 112 provides predetermined heat to and pressure on the paper Q holding the toner image, and fixes the fused toner image to the paper Q.

The delivery roller 113 outputs the paper Q output from the fixing apparatus 112 to the output tray 114 (not shown) provided outside.

The duct 115 has an air inlet and an air outlet. The air inlet is disposed in a region including a heat-radiating member of the image processing apparatus, or a region which requires cooling. The air outlet is disposed to face a heat-absorbing surface of the duct-side thermoelectric converting section 118. In this embodiment, the duct 115 discharges heat generated by heat-radiating sections in the body of the image processing apparatus to the outside. Examples of the heat are heat generated by an optical system (such as rotation of a polygon mirror) of the scanner 101, heat generated by a high-voltage transformer power source of charge wire of the charging device 104, heat generated by motor driver switching elements provided in sections of the apparatus, heat generated by a photosensitive heater (not shown) and a transformer for developing bias of the developing device 106, and heat generated by a circuit which operates an induction heating coil of the fixing apparatus 112. A channel or a tube member to discharge heat to the outside can be used as the duct 115. The outlet of the duct 115 is preferably bent. Thereby, airflow in the bent portion of the outlet is disturbed, and temperature of air discharged to the duct-side thermoelectric converting section 118 is further increased.

The process unit 116 is formed by the photosensitive drum 103, the charging device 104, and the developing device 106. The process unit 116 is detachable from the main body of the image processing apparatus.

The fan 117 actively discharges heat inside of the main body of the image processing apparatus which has flowed downstream through the duct 115.

The duct-side thermoelectric converting section (third thermoelectric converting section) 118 is disposed around the air outlet of the duct mechanism 115, and includes a plurality of thermoelectric converting elements which convert heat generated in the image processing apparatus into electric power. Thermoelectric elements which use the Seebeck effect and generate electromotive force by difference in temperature can be used as the thermoelectric converting elements used in this embodiment. In recent years, heat resistance of thermoelectric converting elements has improved, and elements are known which have heat resistance up to 500° C. as highest temperature and to 20° C. as lowest temperature and outputs 15 W.

Figure 2:
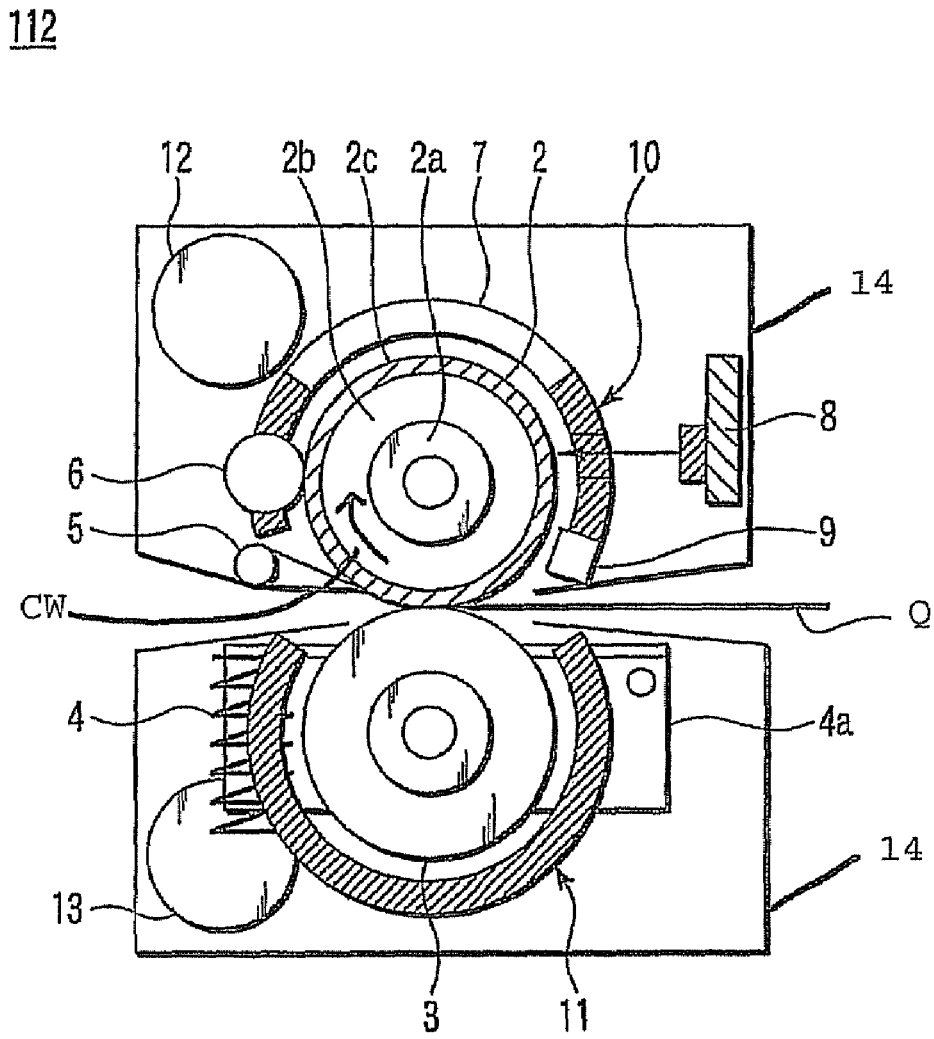
FIG. 2 is a schematic diagram of an example of a fixing apparatus used for the image processing apparatus illustrated in FIG. 1.
Figure 3:
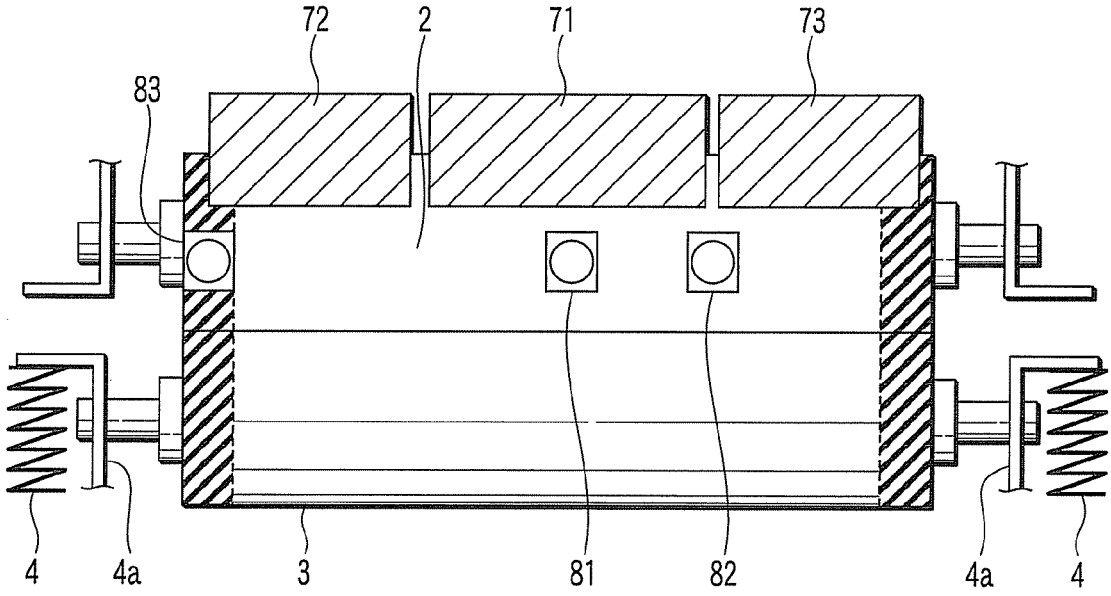
FIG. 3 is a schematic diagram of the fixing apparatus illustrated in FIG. 2 as viewed from another angle.
Figure 4:
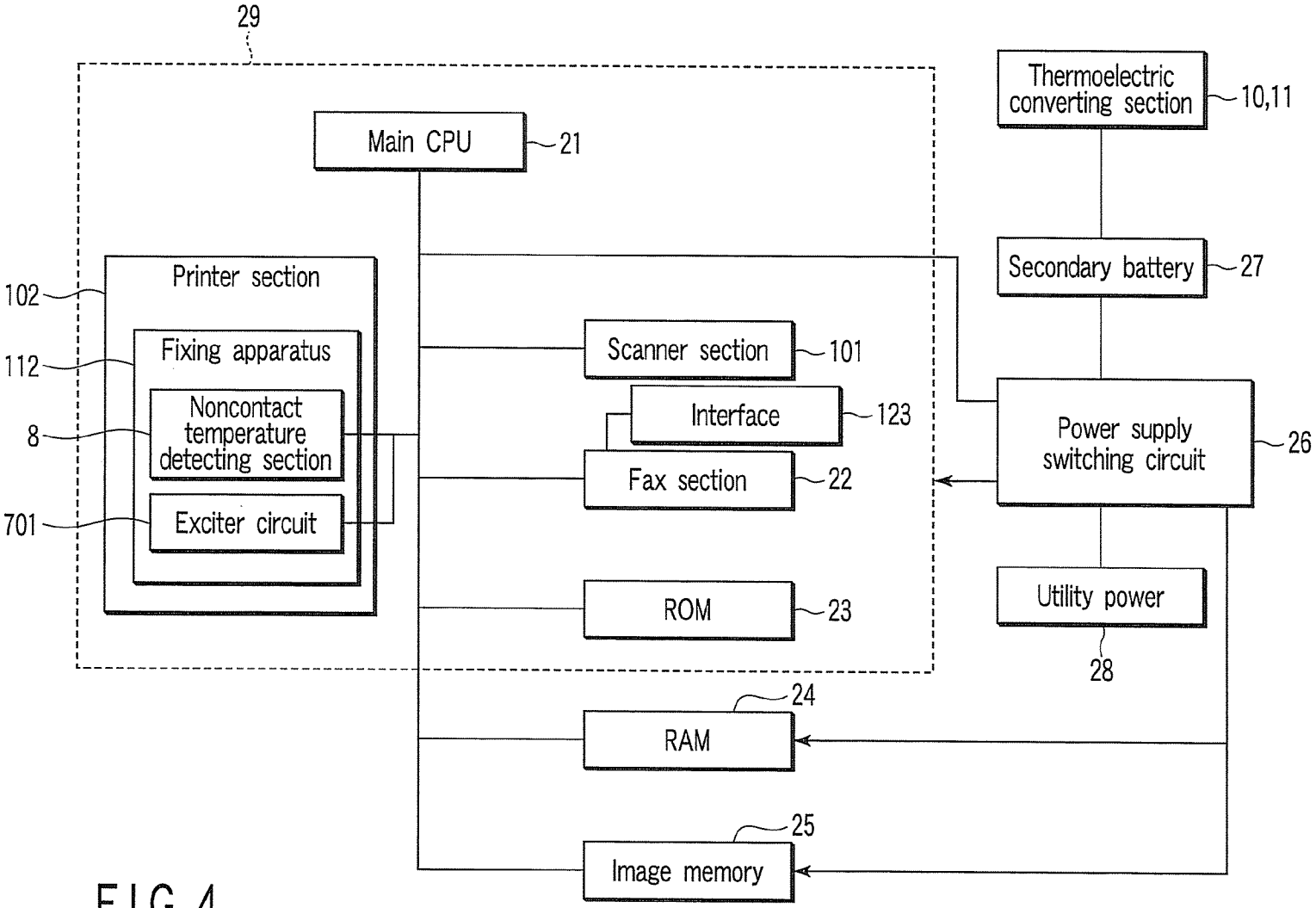
FIG. 4 is a block diagram of a control system of the image processing apparatus illustrated in FIG. 1.

FIG. 2 is a schematic diagram of an example of a fixing apparatus used in the image processing apparatus illustrated in FIG. 1. FIG. 3 is a schematic diagram of the fixing apparatus of FIG. 2 as viewed from another angle. FIG. 4 is a block diagram illustrating a control system of the image processing apparatus illustrated in FIG. 1.

As illustrated in FIG. 1, the fixing apparatus 112 has a heating roller (heat application means) 2, a pressurizing roller (pressurizing means) 3, a pressurizing spring 4, a peeling claw 5, a cleaning roller 6, a heating device 7, a noncontact temperature detecting section 8, a thermostat 9, a first thermoelectric converting section 10, a second thermoelectric converting section 11, cooling sections 12 and 13, and a cover member 14.

The heating roller 2 has a shaft 2*a* formed of a material having stiffness (hardness) with which the shaft is not deformed under a predetermined pressure, an elastic layer (foam rubber layer, sponge layer, silicone rubber layer) 2*b* disposed around the shaft 2*a*, and a conductive layer (metal conductive layer) 2*c* formed around the elastic layer 2*b*. Further, although not shown, a solid rubber layer formed of thin-film layers of heatproof silicone rubber and a mold-releasing layer are preferably formed around the metal conductive layer 2*c* in this embodiment.

The metal conductive layer 2*c* is formed of a conductive material (steel material which can be heated by induction heating, such as nickel, stainless steel, aluminum, copper, and composite material of stainless steel and aluminum). The longitudinal length of the heating roller 2 is preferably 330 mm.

It is preferable that the foam rubber layer 2*b* has a thickness of 5 to 10 mm, the metal conductive layer 2*c* has a thickness of 10 to 300 μm, and the solid rubber layer has a thickness of 100 to 300 μm. In this embodiment, the foam rubber layer 2*b* has a thickness of 8 mm, the metal conductive layer 2*c* has a thickness of 40 μm, the solid rubber layer has a thickness of 200 μm, the mold-releasing layer has a thickness of 30 μm, and the heating roller 2 has a diameter of 50 mm.

The pressurizing roller 3 may be an elastic roller having a structure in which a rotational shaft having a predetermined diameter is coated with silicone rubber or fluorine rubber having a predetermined thickness, or a roller having a metal conductive layer and an elastic layer like the heating roller 2.

The pressurizing spring 4 is in pressure contact with an axis of the heating roller 2 at a predetermined pressure, and the pressurizing roller 3 is maintained in almost parallel with the axis of the heating roller 2. The pressurizing spring 4 is supplied with a predetermined pressure from both ends of the pressurizing roller 3 through a pressurizing support bracket 4*a* supporting the axis of the pressurizing roller 3, and thus can be in parallel with the heating roller 2.

Thereby, a nip having a predetermined width is formed between the heating roller 2 and the pressurizing roller 3.

The heating roller 2 is rotated by a fixing motor (not shown) in a direction of arrow CW at generally constant speed. The pressurizing roller 3 is in contact with the heating roller 2 by the pressurizing spring 4 at predetermined pressure. Therefore, by rotating the heating roller 2, the pressurizing roller 3 is rotated in a direction reverse to the rotation direction of the heating roller 2, at a position contacting the heating roller 2.

The peeling claw 5 is located on a circumference of the heating roller 2, downstream from the nip in which the heating roller 2 and the pressurizing roller 3 contact in the rotational direction of the heating roller 2, and in the vicinity of the nip. The peeling claw 5 peels paper P which has passed through the nip from the heating roller 2. The present invention is not limited to this embodiment. For example, a plurality of peeling claws 5 may be provided, since paper is not easily removed from the heating roller if much developing agent is fixed to the paper as in color image processing. Further, the peeling claw may not be provided, in the case of adopting a structure where paper is easily removed from the heating roller.

The cleaning roller 6 removes offset toner and waste such as paper waste on the surface of the heating roller 1.

The heating device 7 is disposed outside the heating roller 2, and has at least one heating coil (exciter coil) which is supplied with a predetermined electric power and supplies a predetermined magnetic field to the heating roller 2. When a predetermined electric power is supplied from an exciter circuit 701 (see FIG. 4) described below to the heating coil and a magnetic field is generated, an eddy-current flows in the metal layer 2*c* of the heating roller 2, and the heating roller 2 is subjected to induction heating.

The noncontact temperature detecting section 8 is provided in a noncontact manner with the surface of the heating roller 2, and detects the temperature of the outer circumferential surface of the heating roller 2.

The thermostat 9 is used to sense abnormal heat radiation in which the surface temperature of the heating roller 2 abnormally increases, and shut off the electric power supplied to the heating coil of the heating device 7 if abnormal heat radiation occurs. It is preferable that at least one thermostat 9 is provided near the surface of the heating roller 2, more preferably in a number corresponding to the number of the heating coil(s).

Each of the first thermoelectric converting section (first thermoelectric converting means) and the second thermoelectric converting section (second thermoelectric converting means) has a plurality of thermoelectric converting elements which convert heat generated in the fixing apparatus 112 into electric power. Each of thermoelectric elements which can be used in this embodiment has a heat-absorbing surface and a cooling surface, and generates electromotive force by difference in temperature between the heat-absorbing surface and the cooling surface, by using the Seebeck effect.

The first thermoelectric converting section 10 is formed along the outer circumferential surface (curved surface) of the heating roller 2. The heat-absorbing surface of the first thermoelectric converting section 10 is disposed to face the outer circumferential surface of the heating roller 2, and the cooling surface is disposed on a surface distant from the heating roller 2. The second thermoelectric converting section 11 is formed along the curved surface of the pressurizing roller 3. The heat-absorbing surface of the second thermoelectric converting section 11 is disposed to face the outer circumferential surface of the pressurizing roller 3, and the cooling surface is disposed on a surface on an outer side of the heat-absorbing surface. The heat-absorbing surfaces of the first and second thermoelectric converting sections 10 and 11 are disposed close to the heating roller 2 and the pressurizing roller 3, respectively, with a predetermined space. Further, the first and second thermoelectric converting sections 10 and 11 are preferably formed to be longer than the longitudinal length of the heating roller 2 and the pressurizing roller 3, respectively, to cover the heating roller 2 and the pressurizing roller 3, respectively. Although not shown, each of the first and second thermoelectric converting sections 10 and 11 may have windows to dispose the peeling claw 5, the cleaning roller 6, the heating device 7, the noncontact temperature detecting section 8, and the thermostat 9.

The cooling section (cooling means) 12 is disposed close to the cooling surface of the first thermoelectric converting section 10, and cools a region detected from the cooling surface. The cooling section 13 is disposed close to the cooling surface of the second thermoelectric converting section 11, and cools a region detected from the cooling surface. This increases difference in temperature between the heat-absorbing surface and the cooling surface, and enables effective generation of electromotive force by the Seebeck effect. Heat sinks, heat pipes, FAX, and coolers can be used as the cooling sections 12 and 13.

The cover member 14 covers the fixing apparatus. Thereby, fluctuations in temperature in the fixing apparatus are suppressed to a minimum.

Further, a peeling claw to peel paper Q from the pressurizing roller 3 and a cleaning roller which removes toner adhered to the circumferential surface of the pressurizing roller 3 may be provided on the circumference of the pressurizing roller 3.

Paper Q holding toner passes through the nip portion formed between the heating roller 2 and the pressurizing roller 3, and thereby fused toner is fixed by pressure on the paper Q and an image is fixed to the paper Q.

More specifically, as illustrated in FIG. 3, the heating device 7 includes a center coil 71 disposed in the longitudinal center of the heating roller 2, and end coils 72 and 73 disposed at both ends of the center coil 71. The center coil 71 supplies a predetermined magnetic field to the central portion of the heating roller 2 to perform induction heating, and the end coils 72 and 73 supply a predetermined magnetic field to end portions of the heating roller 2 to perform induction heating. The heating device 7 heats the surface of the heating roller 2 to a predetermined temperature. Electric power supplied from an exciter circuit 701 explained below to the center coil 71 and the end coils 72 and 73 and the timing of supplying the electric power are controlled. In this embodiment, the longitudinal length of the center coil 71 is equal to a length of the shorter sides of paper (for example, a length of the shorter sides of A4 paper) passing through the nip.

The noncontact temperature detecting section 8 includes a noncontact temperature detecting element 81 which detects the surface temperature of the heating roller 2 facing the center coil 71, a noncontact temperature detecting element 82 which detects the surface temperature of the heating roller 2 facing a joint portion between the center coil 71 and the end coil 73, and a noncontact temperature detecting element 83 which detect the surface temperature of an end portion of the heating roller 2 facing an end portion of the end coil 72. The exciter circuit 701 explained below controls an electric power amount supplied to the center coil 71 and the end coils 72 and 73, on the basis of detected temperatures from the noncontact temperature detecting elements 81 to 83. More specifically, the exciter circuit 701 supplies electric power from utility power to the exciter coils 71 to 73 by using a normal mode, if detected temperatures from the noncontact temperature detecting elements 81 to 83 are equal to or greater than a first preset value (for example, 160° C.). If detected temperatures from the noncontact temperature detecting elements 81 to 83 are less than the first preset value (for example, 160° C.), the exciter circuit 701 supplies electric power from an auxiliary power supply (secondary battery) to the exciter coils 71 to 73, starts a warm-up, and heats the heating roller 2 to a second preset value (for example, 180° C.) which is a fixing temperature.

If a detected temperature from the noncontact temperature detecting element 81 continues to be abnormal temperature, rotation of the heating roller 2 stops, and thereby it is detected that only a predetermined region of the heating roller 2 is kept heated. Further, if a detected temperature of the noncontact temperature detecting element 82 decreases, there is the possibility that unevenness shows up in an image formed on the paper Q and the image quality deteriorates. Therefore, the exciter circuit 701 controls the electric power supplied to the center coil 71 and the end coils 72 and 73 and the timing of supplying the electric power, on the basis of the detected temperature from the noncontact temperature detecting element 82. Thereby, variations in temperature in the longitudinal direction of the heating roller 2 are reduced. The present invention is not limited to this structure, but may adopt a structure in which electric power supplied to the center coil 71 and the end coils 72 and 73 is changed on the basis of detected temperatures from the noncontact temperature detecting elements 81 to 83, to improve variations in temperature in the longitudinal direction of the heating roller 2 due to continuous passing of paper through a region corresponding to the center coil 71.

FIG. 4 is a block diagram illustrating a control system of the image processing apparatus illustrated in FIG. 1.

As illustrated in FIG. 4, the image processing apparatus 100 has a main CPU 21 which controls the image processing apparatus 100. The main CPU 21 is connected to the scanner section 101, the printer section 102, a fax section 22, a ROM 23, a RAM 24, an image memory 25, and a power supply switching circuit 26.

As described above, the scanner section 101 reads an image of reading or copying object (original) P, generates an image signal, performs predetermined image processing in an image processing section (not shown), and outputs the signal to the fax section 22 or the image memory 25. The image processing section subjects an input image signal to, for example, predetermined image processing, and outputs the signal as image data which is amplified to a predetermined threshold level and recognized as character information and image information.

As described above, the printer section 102 includes the fixing apparatus 112, the noncontact temperature detecting section 8, and the exciter circuit 701. The printer section 102 forms an image based on image data output from the scanner section 101 or the fax section 22.

The fax section 22 is connected to the interface 123. The fax section 22 transmits image data output from the scanner section 101 by facsimile, and outputs image data received by facsimile to the printer section 102.

The ROM 23 stores programs which controls sections of the image processing apparatus 100. The ROM 23 also stores a time table to calculate the electric power amount stored in a secondary battery 27 in accordance with the number of image-formed sheets.

The RAM 24 includes a work area necessary for predetermined processing operation of the main CPU 21. Although not shown, the RAM 24 may include an NVRAM (nonvolatile RAM) which is nonvolatile and can hold stored data even when the power source is shut down.

The image memory 25 stores image data output from the scanner section 101 and the fax section 22, and image data received through the interface 123.

The power supply switching circuit 26 is connected to the secondary battery 27 and a utility power 28. The power supply switching circuit 26 switches electric power to be supplied to at least one of the main CPU 21, the noncontact temperature detecting section 8 and the exciter circuit 701 in the printer section 102, the scanner section 101, the fax section 22 and the ROM 23 in a switching group 29, which is enclosed by a dotted line in FIG. 4, in accordance with instructions from the main CPU 21. In other words, the power supply switching circuit 26 switches the apparatus between a first state, in which electric power is supplied from the utility power 28 to the center coil 71 and the end coils 72 and 73 being heating members, and a second state, in which electric power is supplied from the secondary battery 27 to the center coil 71 and the end coils 72 and 73, in accordance with a predetermined instruction signal output from the main CPU 21.

The secondary battery 27 is, for example, a capacitor and a battery, and configured to be charged with electric power generated by the first and second thermoelectric converting sections 10 and 11. The secondary battery 27 is preferably detachable from the main body of the image processing apparatus.

The main CPU 21 approximates the electric power stored in the secondary battery 27, based on the time table stored in the ROM 23.

Figure 5:
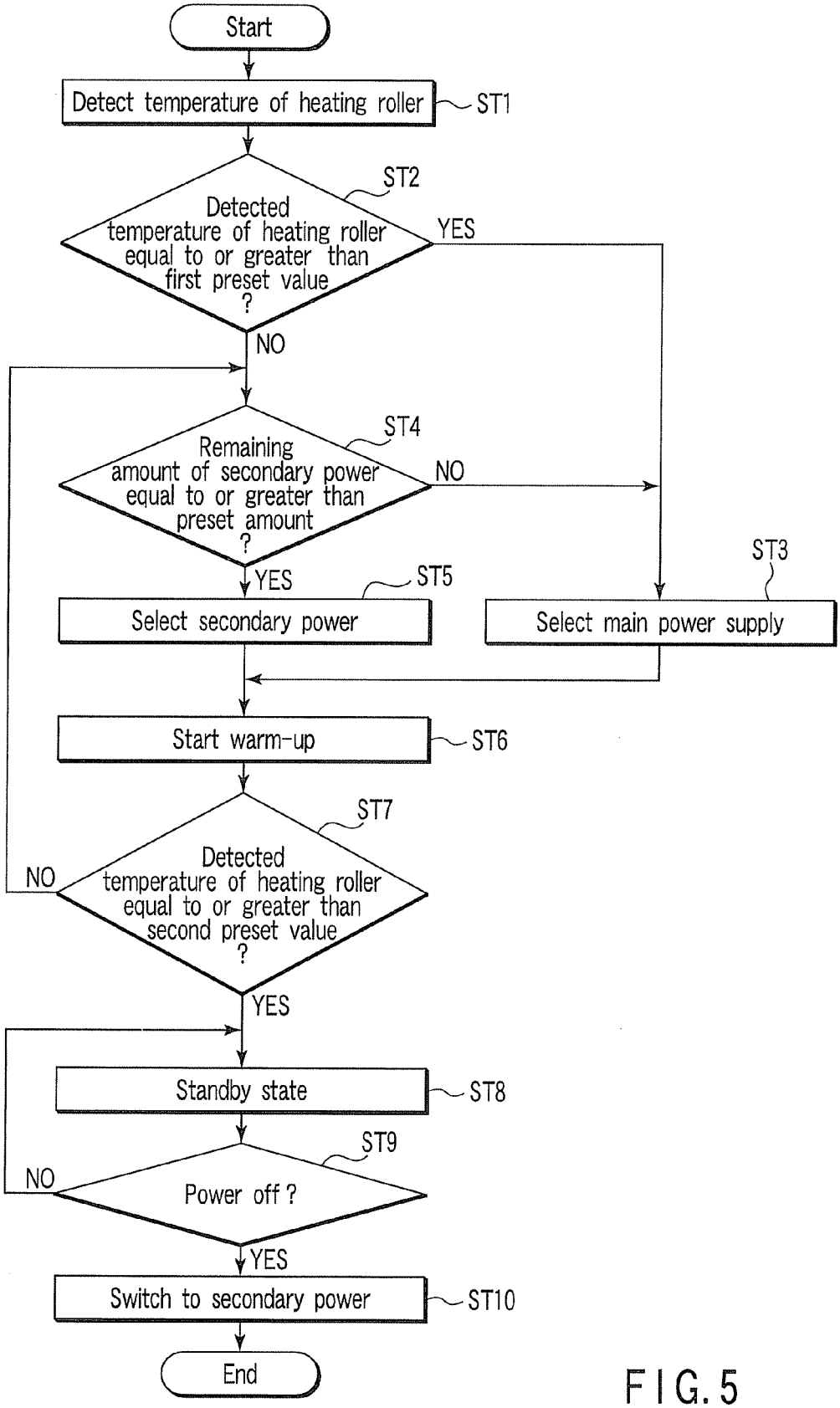
FIG. 5 is a flowchart illustrating an example of a method of heating the fixing apparatus illustrated in FIG. 2.

Next, a method of heating the fixing apparatus mounted on the image processing apparatus of FIG. 1 is explained with reference to FIG. 5.

When the power of the image processing apparatus is turned on, electric power is supplied to the noncontact temperature detecting elements 81 to 83. Then, as illustrated in FIG. 5, the surface temperature of the heating roller 2 is detected by the noncontact temperature detecting elements 81 to 83 (ST1), and it is determined whether the detected surface temperatures are equal to or greater than the first preset value (160° C.) (ST2). If all the detected temperatures of the noncontact temperature detecting elements 81 to 83 are equal to or greater than the first preset value (ST2—YES), the power supply switching circuit 26 switches the apparatus to the first state, and selects the utility power 28 as the electric power to be supplied to the coils 71 to 73 (ST3).

On the other hand, in step ST2, if at least one of the temperatures detected by the noncontact temperature detecting elements 81 to 83 is less than the first preset value (ST2—NO), it is determined whether the secondary battery 27 has a remaining electric power amount corresponding to a preset amount with which a warm-up can be performed (ST4). If the remaining amount of the secondary battery 27 is less than the preset amount (ST4—NO), the apparatus goes to step ST3, and the power supply switching circuit 26 switches the apparatus to the first state, and selects the utility power 28 as the electric power to be supplied to the coils 71 to 73 (ST3). If it is determined in step ST4 that the remaining amount of the secondary battery 27 is equal to or greater than the preset amount and is sufficiently secured (ST4—YES), the power supply switching circuit 26 switches the apparatus to the second state, and selects the secondary battery 27 as the power supply which supplies power to the coils 71 to 73 (ST5).

The exciter circuit 701 starts a warm-up based on electric power supplied from the power supply selected by the power supply switching circuit 26 in step ST3 or ST5 as described above, and heats the heating roller 2 by a predetermined method (ST6).

Then, it is determined whether the surface temperatures of the heating roller 2 detected by the noncontact temperature detecting elements 81 to 83 are equal to or greater than the second preset value (180° C.) (ST7). If all the temperatures detected by the noncontact temperature detecting elements 81 to 83 are equal to or greater than the second preset value (ST7—YES), the exciter circuit 701 ends the warm-up, and the apparatus comes into a standby state (ST8). In step ST7, if the surface temperature of the heating roller 2 is less than the second preset value (180° C.), the apparatus returns to step ST4, and warm-up is continued.

If the power of the image processing apparatus is turned off (ST9—YES), the power supply switching circuit 26 switches the apparatus to the second state, selects the secondary battery 27 as electric power to be supplied to the coils 71 to 73 (ST10). If the power of the image processing apparatus is on (ST9—NO), the apparatus returns to step ST8, and is on standby.

As described above, the charged electric power of the secondary battery 27 is used for a warm-up, and thereby the heat capacity of the exciter circuit 701 is increased without increasing the electric power of the utility power 28, even in a warm-up which requires more power amount than in the normal mode. This structure shortens the warm-up time, and improves the heat-generation efficiency. Further, heat generated in the image processing apparatus is converted into electric power by the thermoelectric converting section 118, heat generated by the fixing apparatus is converted into electric power by the thermoelectric converting sections 10 and 11, and the secondary battery 27 is charged with these electric powers. This structure effectively uses energy, and contributes to energy conservation. Further, when the power of the image processing apparatus is turned off, the electric power stored in the secondary battery 27 is supplied to communication system which performs and operation consuming small electric power amount such as transmission/reception of facsimile, storage of images read from the scanner 101, and operation of the fan 117, or a communication system such as RUN and a network. This structure provides a fixing apparatus with power conservation function, and an image processing apparatus with power conservation function.

Further, as illustrated in FIG. 2, the thermoelectric converting sections 10 and 11 are arranged inside the cover member 14 and close to the outer circumferential surface of the heating roller 2 and the pressurizing roller 3, respectively, and thereby thermal energy absorbed by the heat-absorbing surfaces is efficiently converted into electric power. Furthermore, the cooling sections 12 and 13 are arranged on the cooling surfaces, and thereby difference in temperature between the heat-absorbing surface and the cooling surface increases, and electromotive force caused by the Seebeck effect is efficiently generated.

In this embodiment, the duct-side thermoelectric converting section 118 explained with reference to FIG. 1 has a specific structure illustrated in FIG. 6.

Figure 6:
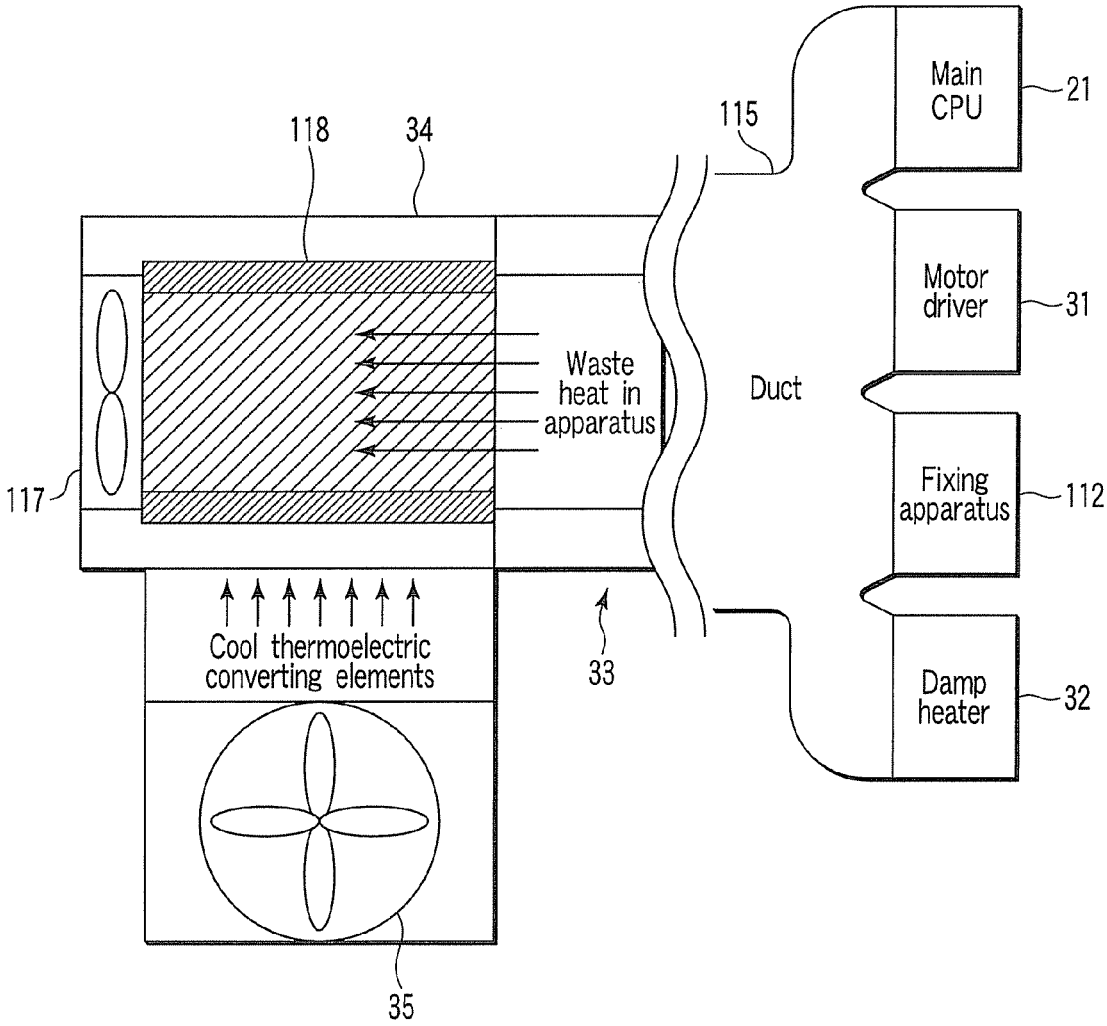
FIG. 6 is a schematic diagram illustrating a structure of a thermoelectric converting section and therearound illustrated in FIG. 1.

As illustrated in FIG. 6, the duct-side thermoelectric converting section 118 is disposed such that heat from an outlet 33, which is made by combining outlets of the duct discharging heat from the main CPU 21, a motor driver 31 having a function of rotating the heating roller 2, the fixing apparatus 112, and a damp heater 32, is discharged to the heat-absorbing surface of the duct-side thermoelectric converting section 118. Further, a cooling duct 34 and a cooling fan 35 are provided on the cooling-surface side of the duct-side thermoelectric converting section 118 to cool the cooling surface of the duct-side thermoelectric converting section 118. The fan 117 to actively discharge heat discharged from the outlet 33 to the outside is disposed on the other side of the duct-side thermoelectric converting section 118 opposite to the outlet 33.

The present invention is not limited to the above embodiment, but can be carried out by varying the constituent elements within the range not departing from the gist of the invention. Further, various inventions can be formed by combining constituent elements disclosed in the embodiment as required. For example, some constituent elements can be removed from all the constituent elements disclosed in the embodiment. Further, constituent elements of different embodiments can be used in combination.

Further, although it is explained in the above embodiment that the set value (the second preset value) being the fixing temperature of the heating roller 2 is 180° C., the present invention is not limited to it, but the setting can be changed according to the structure of the apparatus and the melting point of developer to be used. Further, the set value varies according to the size, type, or thickness of the recording medium. For example, if the recording medium has a large thickness, the value is set to a temperature higher than a normal preset value.

Further, the present invention can be a method in which heating power is changed by selecting the frequency of electric current flowing through the coils 71 to 73.

Further, although the above embodiment has a structure in which pressure is applied from the pressurizing roller 3 to the heating roller 2, the present invention is not limited to it, but may have a structure in which pressure is applied from the heating roller 2 to the pressurizing roller 3.

Furthermore, the fixing apparatus according to the present invention may be a fixing apparatus which can perform color copy, or a fixing apparatus which can perform monochrome copy.

Further, the first thermoelectric converting section 10 explained with reference to FIG. 2 can be configured to cover the peeling claw 5, the cleaning roller 6, the induction heating device 7, and the thermostat 9, and provided with window portions such that the noncontact temperature detecting section 8 disposed outside the first thermoelectric converting section 10 can detect the temperature of the detection regions of the heating roller 2.

Further, the peeling claw 5, the cleaning roller 6, the induction heating device 7, the noncontact temperature detecting section 8, the thermostat 9 and the first thermoelectric converting section 10 may be formed as one body by molding.

Further, a frame formed by a member having low thermal conductivity is preferably disposed outside each of the first and second thermoelectric converting sections 10 and 11 to cover them. A space of 2 to 30 mm is preferably formed between the frame and the first thermoelectric converting section 10 or the second thermoelectric converting section 11. More preferably a heat insulator is disposed between the frame and the thermoelectric converting section. If the space between the frame and the first thermoelectric converting section 10 or the second thermoelectric converting section 11 exceeds 30 mm, airflow in the space is slow, and thus it may be necessary to increase the size of the fan 117.

Further, the NVRAM included in the RAM 24 can be a nonvolatile memory backed up by the secondary battery 27.

Although it is explained in the above embodiment that the heating device 7 includes an exciter coil and an exciter circuit and heats the heating roller 2 by induction heating, the present invention is not limited to it. For example, the heating device 7 may have a structure of heating the heating roller 2 by a halogen lamp or the like.

In the warm-up method explained with reference to FIG. 5, it is possible to perform control of temporarily increasing electric power supplied to the exciter coil of the heating device 7, if the temperature does not reach a preset temperature within a predetermined warm-up time.

The frames holding the first and the second thermoelectric converting sections 10 and 11 may be molded resin formed by injection molding, or sheet metal.

The member forming the duct 115 may be molded resin formed by injection molding, or a member formed of a heat-insulating material (such as PPS, glass cloth laminated material, polyimide resin, and silicone resin). Further, it is possible to adopt a structure in which the duct 115 is coated with a member formed of a heat-insulating material.

In the above embodiment, the utility power 28 can output electric power of 1000 W with rated voltage 100 V and 10 A current. In comparison with this, when the power supply switching circuit 26 switches the apparatus to the second state, the secondary battery 27 can output electric power of 1100 W for about 3 seconds.

What is claimed is:

1. A fixing apparatus comprising:

a heating roller which provides heat to a developer-holding medium holding a developer image;

a pressurizing roller which is in contact with the heating roller;

a heating device having a plurality of heating members which heat the heating roller;

a first thermoelectric converting section having a plurality of thermoelectric converting elements and formed along a curved surface of the heating roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the heating roller;

an auxiliary power supply charged with electric power generated by the first thermoelectric converting section;

a second thermoelectric converting section having a plurality of thermoelectric converting elements and formed along a curved surface of the pressurizing roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the pressurizing roller, the second thermoelectric converting section generating electric power being used for charging the auxiliary power supply; and a switching section which switches a first state in which electric power is supplied from utility power to the heating members and a second state in which electric power is supplied from the auxiliary power supply to the heating members, based on a predetermined signal, wherein the switching section supplies electric power from the utility power to all the heating members in the first state, and supplies electric power from the auxiliary power supply to all the heating members in the second state.

2. The apparatus of claim 1 further comprising:

a cover which covers the fixing apparatus, wherein the first thermoelectric converting section and the second thermoelectric converting section are disposed inside the cover.

3. The apparatus of claim 2, further comprising:

a cooling section which is disposed inside the cover and close to the cooling surfaces of at least one of the heating roller and the pressurizing roller, and cools the cooling surfaces.

4. An image processing apparatus comprising:

an image carrier which forms an electrostatic latent image;

a developing device which provides a developer to the image carrier and thereby changes the electrostatic latent image into a developer image;

a transfer device which transfers the developer formed on the image carrier to a developer-holding medium;

a fixing apparatus including:

a heating roller which provides heat to the developer-holding medium holding the developer image;

a pressurizing roller which is in contact with the heating roller;

a heating device having a plurality of heating members which heat the heating roller;

a first thermoelectric converting section having a plurality of thermoelectric converting elements and formed along a curved surface of the heating roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the heating roller;

an auxiliary power supply charged with electric power generated by the first thermoelectric converting section; and a second thermoelectric converting section having a plurality of thermoelectric converting elements and formed along a curved surface of the pressurizing roller, each of the thermoelectric converting elements having a heat-absorbing surface and a cooling surface and generating electromotive force by difference in temperature between the heat-absorbing surface and the cooling surface, the heat-absorbing surface being disposed with a predetermined space from an outer circumferential surface of the pressure roller, the second thermoelectric converting section generating electric power being used for charging the auxiliary power supply;

a switching section which switches a first state in which electric power is supplied from utility power to the heating members and a second state in which electric power is supplied from the auxiliary power supply to the heating members, based on a predetermined signal; and a control section which outputs the predetermined signal to the switching section, and thereby instructs switching between the first state and the second state, wherein the switching section supplies electric power from the utility power to all the heating members in the first state, and supplies electric power from the auxiliary power supply to all the heating members in the second state.

5. The apparatus of claim 4, further comprising:

a cover which covers the fixing apparatus, wherein the first thermoelectric converting section and the second thermoelectric converting section are disposed inside the cover.

6. The apparatus of claim 5, further comprising:

a cooling section which is disposed inside the cover and close to the cooling surfaces of at least one of the heating roller and the pressurizing roller, and cools the cooling surfaces.

7. The apparatus of claim 4, wherein the control section outputs the predetermined signal to the switching section to switch the first state to the second state, when the image processing apparatus is in a warm-up state.

8. The apparatus of claim 4, further comprising:

a duct mechanism which has an air inlet and an air outlet and discharges heat taken in by the inlet to outside through the air outlet; and a third thermoelectric converting section having a plurality of thermoelectric converting elements, each of the thermoelectric converting elements having a heat-absorbing surface and a cooling surface and generating electromotive force by difference in temperature between the heat-absorbing surface and the cooling surface, the heat-absorbing surface being disposed close to the air outlet of the duct mechanism, the third thermoelectric converting section generating electric power being used for charging the auxiliary power supply.

9. The apparatus of claim 4, wherein the heating device includes an exciter coil as the heating members, and heats the heating roller by induction heating.

* * * * *